US010160248B2

(12) United States Patent
Aoai et al.

(10) Patent No.: US 10,160,248 B2
(45) Date of Patent: Dec. 25, 2018

(54) PROCESSING FLUID, IMAGE FORMING METHOD, RECORDED MATTER, AND INKJET RECORDING DEVICE

(71) Applicants: Shosuke Aoai, Kanagawa (JP); Michihiko Namba, Kanagawa (JP)

(72) Inventors: Shosuke Aoai, Kanagawa (JP); Michihiko Namba, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 289 days.

(21) Appl. No.: 14/729,193

(22) Filed: Jun. 3, 2015

(65) Prior Publication Data

US 2015/0367667 A1 Dec. 24, 2015

(30) Foreign Application Priority Data

Jun. 19, 2014 (JP) ..... 2014-126133
Sep. 25, 2014 (JP) ..... 2014-194766
Dec. 25, 2014 (JP) ..... 2014-262874

(51) Int. Cl.
*B41M 5/52* (2006.01)
*B41M 5/00* (2006.01)

(52) U.S. Cl.
CPC ..... *B41M 5/5245* (2013.01); *B41M 5/0017* (2013.01); *B41M 5/5218* (2013.01); *Y10T 428/24802* (2015.01)

(58) Field of Classification Search
CPC ..... B41M 5/50
See application file for complete search history.

(56) References Cited

U.S. PATENT DOCUMENTS 5,378,675 A * 1/1995 Takeyama ..... B41M 5/44 428/206
6,786,588 B2 * 9/2004 Koyano ..... B41M 5/0017 347/100
2009/0219330 A1 * 9/2009 Kiyomoto ..... B41M 5/0017 347/21
2010/0003417 A1 * 1/2010 Arai ..... C09D 11/54 427/385.5

(Continued)

FOREIGN PATENT DOCUMENTS

JP 4-331182 11/1992
JP 7-268665 10/1995

(Continued)

OTHER PUBLICATIONS

Hubbe, Martin. Mini-Encyclopedia of Wet End Chemistry-Polyamines. http://www4.ncsu.edu/~hubbe/PAMN.htm (Obtained Oct. 15, 2017).*

*Primary Examiner* — Gerard Higgins
*Assistant Examiner* — Sathavaram I Reddy
(74) *Attorney, Agent, or Firm* — Oblon, McClelland, Maier & Neustadt, L.L.P.

(57) ABSTRACT

A processing fluid contains a water soluble cation polymer having a quaternary ammonium cation in the main chain, either of one of phosphoric acid-based inorganic salt and p-tert-butyl benzoate, and water, wherein the phosphoric acid-based inorganic salt is either of one of disodium monohydrogen phosphate, sodium dihydrogen phosphate, sodium polyphosphate, dipotassium monohydrogen phosphate, and potassium dihydrogen phosphate, wherein the water soluble cation polymer accounts for 40% by weight to 60% by weight.

19 Claims, 3 Drawing Sheets

(56) References Cited

U.S. PATENT DOCUMENTS

| | | | | |
|---|---|---|---|---|
| 2010/0245416 | A1 | 9/2010 | Ohshima et al. | |
| 2011/0292116 | A1* | 12/2011 | Sago | C09D 11/322 347/21 |
| 2012/0249701 | A1* | 10/2012 | Sasada | C09D 11/101 347/102 |
| 2013/0143008 | A1 | 6/2013 | Gotou et al. | |

FOREIGN PATENT DOCUMENTS

| | | |
|---|---|---|
| JP | 8-035090 | 2/1996 |
| JP | 2004-210881 | 7/2004 |
| JP | 2009-137052 | 6/2009 |
| JP | 2011-063016 | 3/2011 |
| JP | 2012-040778 | 3/2012 |
| JP | 2012-046633 | 3/2012 |
| JP | 2012-207338 | 10/2012 |
| JP | 2013-087357 | 5/2013 |
| JP | 2013-163370 | 8/2013 |

* cited by examiner

PROCESSING FLUID, IMAGE FORMING METHOD, RECORDED MATTER, AND INKJET RECORDING DEVICE

CROSS-REFERENCE TO RELATED APPLICATIONS

This patent application is based on and claims priority pursuant to 35 U.S.C. § 119(a) to Japanese Patent Application Nos. 2014-126133, 2014-194766, and 2014-262874, filed on Jun. 19, 2014, Sep. 25, 2014, and Dec. 25, 2014, respectively, in the Japan Patent Office, the entire disclosures of which are hereby incorporated by reference herein.

BACKGROUND

Technical Field

The present invention relates to a processing fluid, an image forming method using the processing fluid, recorded matter, and an inkjet recording device.

Background Art

In an image forming method employing inkjet system, using a processing fluid containing a cation polymer is well known, which reacts with pigments in an ink or prevents dissolution of pigments to improve image quality by increasing image density and preventing strike-through and bleed.

However, typical processing fluids are capable of ameliorating image quality but at the same time have a problem that chlorine ion, which is a counter ion of a cation polymer, corrodes members that contact the processing fluids. In addition, changing the counter ion faces a cost problem so that the members themselves have been changed or processed.

SUMMARY

According to the present invention. provided is a processing fluid which contains a water soluble cation polymer having a quaternary ammonium cation in the main chain, either of one of phosphoric acid-based inorganic salt and p-tert-butyl benzoate, and water, wherein the phosphoric acid-based inorganic salt is either of one of disodium monohydrogen phosphate, sodium dihydrogen phosphate, sodium polyphosphate, dipotassium monohydrogen phosphate, and potassium dihydrogen phosphate, wherein the water soluble cation polymer accounts for 40% by weight to 60% by weight.

BRIEF DESCRIPTION OF THE SEVERAL VIEWS OF THE DRAWINGS

Various other objects, features and attendant advantages of the present invention will be more fully appreciated as the same become better understood from the detailed description when considered in connection with the accompanying drawings, in which like reference characters designate like corresponding parts throughout and wherein.

DETAILED DESCRIPTION

Figure 1:
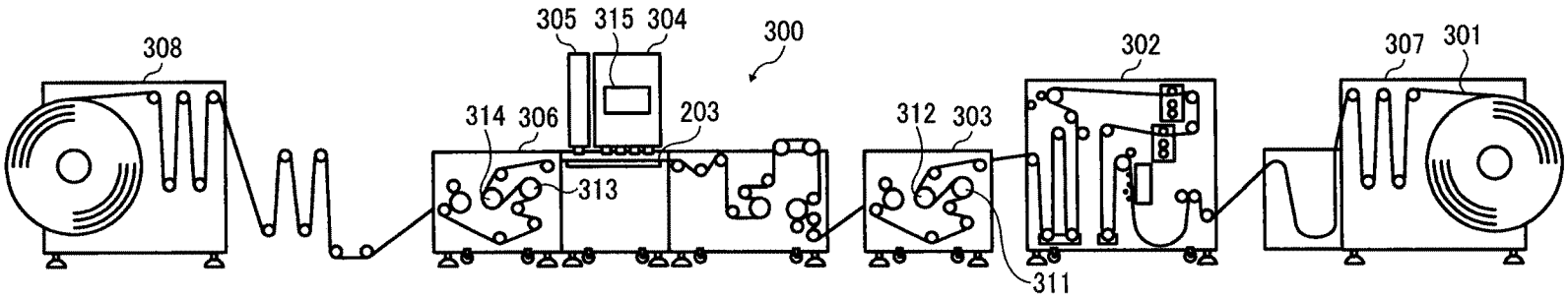
FIG. 1 is a schematic diagram illustrating an example of an ink jet recording device of the present disclosure.

According to the present invention, provided is a processing fluid which suppresses corrosion of members that contact the processing fluid while securing good image quality even when images are formed in high performance.

The processing fluid contains a flocculant to destroy dispersion of an ink and promote agglomeration thereof. Chlorine ions contained as counter ions to the flocculant causes pitting reaction to the passivation film of stainless steel (SUS) member, which accelerates corrosion. To prevent corrosion, if the flocculant is changed to other flocculants suitable to improve image quality, target image quality is not achieved. Moreover, selecting counter ions other than chlorine ion invites cost increase.

Furthermore, if images are formed at about 10 m/minute to about 200 m/minute, which is higher than typical image forming speed, the addition amount of a flocculant is increased, thereby accelerating corrosion.

As a result of further investigation, the present inventors have found that, by adding a phosphoric acid-based inorganic salt or p-tert-butyl benzoate to the processing fluid, a passivation film is newly formed by the phosphoric acid-based inorganic salt or p-tert-butyl benzoate at the place where the passivation film of SUS member was pitted, so that the corrosion speed is suppressed, which obviates the need for changing the identity of flocculant, leading to improvement of image quality. Thus, the present invention was made.

The present disclosure includes:

1. A processing fluid contains a water soluble cation polymer having a quaternary ammonium cation in the main chain, either of one of phosphoric acid-based inorganic salt and p-tert-butyl benzoate, and water, wherein the phosphoric acid-based inorganic salt is either of one of disodium monohydrogen phosphate, sodium dihydrogen phosphate, sodium polyphosphate, dipotassium monohydrogen phosphate, and potassium dihydrogen phosphate, wherein the water soluble cation polymer accounts for 40% by weight to 60% by weight.

The present disclosure will be described below in detail with reference to several embodiments and accompanying drawings. Embodiment of 1 of the present disclosure described above also includes the following 2 to 9. Therefore, these are also described.

2. The processing fluid mentioned in 1, further contains a citrate.

3. The processing fluid mentioned in 1 or 2, wherein the phosphoric acid-based inorganic salt contains at least disodium monohydrogen phosphate.

4. The processing fluid mentioned in any one of 1 to 3, wherein p-tert-butyl benzoate contains a sodium salt or a potassium salt.

5. The processing fluid mentioned in any one of 1 to 4, wherein the water soluble cation polymer has a repeating unit represented by the following chemical formula 1.

Chemical Formula 1

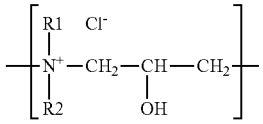

where R1 and R2 each, independently represent alkyl groups, hydroxyalkyl groups, alkenyl groups, or benzyl groups, each having one to eight carbon atoms.

6. An image forming method contains providing the processing fluid mentioned in any one of 1 to 5 to a recording medium; discharging an aqueous ink to the recording medium by an inkjet method to form an image thereon.

7. The image forming method mentioned in 6, wherein the recording medium has a coated layer on one side of a substrate of the recording medium.

8. Printed matter in which an image is recorded by the image forming method mentioned in 6 or 7.

9. An image forming apparatus including a processing fluid providing device to provide the processing fluid mentioned in any one of 1 to 5 to a recording medium; and an image forming device to discharge an aqueous ink to the recording medium by an inkjet method to form an image thereon.

Processing Fluid

The processing fluid of the present disclosure contains the water soluble cation polymer and a phosphoric acid-based inorganic salt or p-tert-butyl benzoate to prevent corrosion of members that contact the processing fluid. In addition, known materials for the processing fluid such as water soluble organic solvents, solid wetting agents, surfactants, permeating agents, defoamers, and pH regulators can be added.

Flocculant (Water Soluble Cation Polymer Having Quaternary Ammonium Cation in Main Chain)

Flocculants are used to destroy dispersion of an ink and promote agglomeration thereof to obtain high image density and dot uniformity. As a result, bleed and white void are prevented, thereby improving the image quality.

The addition amount of the flocculant accounts for 40% by weigh to 60% by weight in the entire processing liquid. When the addition amount is less than 40% by weight, the image forming speed is from about 10 m/minute to about 200 m/minute, which is higher than typical speed, good image quality is not obtained.

To the contrary, when the addition is greater than 60% by weight, viscosity tends to become excessively high causing trouble about handle of ease.

The water soluble cation polymer having a quaternary ammonium cation in the main chain has no specific limit for selection. Preferred specific examples thereof include, but are not limited to, copolymers of polyamine-epichlorohydrin, copolymers of polyamide-epichlorohydrin, polymers of dialkylallyl ammonium chloride, polymers of dialkyl aminoethyl(meth)acylate quaternary ammonium salt, polymers of modified polyvinyl alcohol dialkyl ammonium salt, and dialkylallyl ammonium salt. Of these, the cation polymer having the repeating unit represented by Chemical formula 1 is particularly preferable.

The weight average molecular weight of the polymer is preferably from 500 to 1,000,000, more preferably from 1,000 to 500,000, and furthermore preferably from 1,000 to 10,000. When the weight average molecular weight is greater than 500, good agglomeration power is obtained. When the weight average molecular weight is less than 1,000,000, it can be used as an aqueous solution.

Copolymers of polyamine-epichlorohydrin can be obtained by known methods polymerizing amine and a monomer containing epichlorohydrin. Copolymers of polyamide-epichlorohydrin can be obtained by known methods of graft polymerization of monomer containing epichlorohydrin to polyamide obtained by polymerizing amine and monomers containing carboxylic acid.

Corrosion Inhibitor (Phosphoric Acid-Based Inorganic Salt and p-Tert-Butyl Benzoate)

Phosphoric acid-based inorganic salt or p-tert-butyl benzoate plays a role of suppressing progress of corrosion reaction by forming a new passivation film to the member in which the passivation film was destroyed by chlorine ion serving as a counter ion to the flocculant.

The addition amount of phosphoric acid-based inorganic salt or p-tert-butyl benzoate is preferably from 0.20% by weight to 2.00% by weight and more preferably from 0.50% by weight to 1.00% by weight. Within the range of from 0.20% by weight to 2.00% by weight, corrosion is sufficiently suppressed.

Phosphoric acid-based inorganic salt or p-tert-butyl benzoate is dissolved or dispersed in liquid solvent such as water, various kinds of water soluble organic solvents, or liquid mixtures thereof.

As the phosphoric acid-based inorganic salt, in terms that pH of the processing fluid is not raised excessively or the agglomeration of cation polymer is not inhibited by addition into the processing fluid, disodium monohydrogen phosphate, sodium dihydrogen phosphate, sodium polyphosphate, dipotassium monohydrogen phosphate, and potassium dihydrogen phosphate are used. Of these, disodium monohydrogen phosphate is preferable. Lithium phosphate, potassium phosphate, and sodium phosphate, which are also phosphoric acid-based inorganic salts, are strong basic so that pH of the processing fluid is raised excessively when these are added to the degree that corrosion is sufficiently suppressed.

When pH is excessively high, the power of agglomerating the cation polymer is degraded, thereby having an adverse impact on beading. pH regulators can be used to adjust the pH, but increase the cost and may precipitate salts, which is not preferable.

Specific examples of p-tert-butyl benzoate include, but are not limited to, p-tert-butyl sodium benzoate, p-tert-butyl potassium benzoate, p-tert-butyl zinc benzoate, and p-tert-butyl benzoate.triethanol amine. In terms of safety and cost, p-tert-butyl sodium benzoate and p-tert-butyl potassium benzoate are preferable.

Corrosion Inhibitor (Citrate)

Although phosphoric acid-based inorganic salt or p-tert-butyl benzoate has the impact as described above, when the passivation film of the stainless member is destroyed and a new passivation film is not formed on even a single slightest portion, corrosion progresses from that portion.

Citrates play a role of suppressing the progress of corrosion reaction by forming chelates with iron ions eluted from the stainless material.

Specific examples of citrates include, but are not limited to, sodium citrate, disodium citrate, trisodium citrate, potassium citrate, ammonium citrate, calcium citrate, lithium citrate, and aluminum citrate. Of these, disodium citrate is preferable in terms of safety, smell, and easiness of forming chelate of eluted iron ion.

The content of citrate has no particular limit and preferably from 0.1% by weight to 2.00% by weight and more preferably from 0.50% by weight to 1.00% by weight. Corrosion is sufficiently suppressed within the range of from 0.10% by weight to 2.00% by weight.

Water Soluble Organic Solvent and Solid Wetting Agent

Water soluble organic solvent and solid wetting agent are added to maintain moisture in the processing fluid. Even when the moisture in the processing fluid evaporates in nozzles for processing fluid and application devices, increase of the viscosity of the processing fluid is suppressed, thereby maintaining the discharging stability of ink. Therefore, it is preferable to use a water soluble organic solvent and a solid wetting agent having a high equilibrium moisture content.

The equilibrium moisture content is an amount of water obtained when evaporation of the water in a solvent and absorption of the water in air are in an equilibrium condition when a mixture (liquid) of a water soluble organic solvent or solid wetting agent and water are left still in air at a constant temperature and humidity. Specifically, the equilibrium moisture content in the present disclosure is obtained as follows: while keeping the temperature and the humidity in a desiccator using a saturated potassium chloride solution in the range of from 22° C. to 24° C. and from 77% to 83%, a petri dish on which 1 g of each of hydrosoluble organic solvent is placed is stored in the desiccator until no mass change is observed followed by calculation based on the following Equation1.

Equilibrium moisture content (% by weight) ={Amount of moisture absorbed in water soluble organic solvent/(Amount of water soluble organic solvent+Amount of moisture absorbed in water soluble organic solvent)}×100 Equation 1

Specific examples of the water soluble organic solvent and the wetting agent includes, but are not limited to, polyols, polyol alkyl ethers, polyol aryl ethers, nitrogen-containing heterocyclic compounds, amides, amines, sulfur-containing compounds, propylene carbonates, and ethylene carbonates.

Of these, a water soluble organic solvent or a wetting agent having an equilibrium moisture content of 30% by weight or more is preferable. A water soluble organic solvent having an equilibrium moisture content of 40% by weight or more (hereinafter referred to as water soluble organic solvent A) is more preferable.

Polyols are particularly preferable. Specific examples of such polyols include, but are not limited to, 1,2,3-butanetriol, 1,2,4-butanetriol, glycerin, diglycerin, diethylene glycol, triethylene glycol, tetraethylene glycol, and 1,3-butanediol. Of these, glycerin and 1,3-butanediol are particularly preferable because they have low viscosity when containing water and can stably maintain the moisture without agglomerating colorants.

It is preferable to contain the water soluble organic solvent A in an amount of 50% by weight or more in the entire of water soluble organic solvent and solid wetting agent because the discharging stability of the processing fluid is improved and adherence of the processing fluid to a recording device can be prevented.

It is suitable to use water soluble organic solvent and/or solid wetting agent having an equilibrium moisture content of less than 30% by weight can be used instead of or in combination with the water soluble organic solvent A.

An example thereof is a sugar group in addition to the compounds specified for the water soluble organic solvent and the solid wetting agent.

Specific examples of the polyols include, but are not limited to, dipropylene glycol, 1,5-pentanediol, 3-methyl-1,3-butanediol, propylene glycol, 2-methyl-2,4-pentanediol, ethylene glycol, tripropylene glycol, hexylene glycol, polyethylene glycol, polypropylene glycol, 1,6-hexane diol, 1,2,6-hexane triol, trimethylol ethane, and trimethylol propane.

Specific examples of the polyol alkyl ethers include, but are not limited to, ethylene glycol monoethyl ether, ethylene glycol monobutyl ether, diethylene glycol monomethyl ether, diethylene glycol monoethyl ether, diethylene glycol monobutyl ether, ethylene glycol mono-2-ethyl hexylether, and propylene glycol monoethyl ether.

Specific examples of the polyol aryl ethers include, but are not limited to, ethylene glycol monophenyl ether and ethylene glycol monobenzyl ether.

Specific examples of the nitrogen-containing heterocyclic compounds include, but are not limited to, 2-pyrolidone, N-methyl-2-pyrolidone, 1,3-dimethyl-2-imidazolidinone, ε-caprolactam, and γ-butylolactone.

Specific examples of the amides include, but are not limited to, formamide, N-methyl formamide, N,N-dimethylformamide, and N,N-diethylformamide.

Specific examples of the amines include, but are not limited to, monoethanol amine, diethanol amine, triethanol amine, N,N-dimethyl monoethanol amine, N-methyl diethanol amine, N-methylethanol amine, N-phenyl ethanol amine, and 3-aminopropyl diethylamine.

Specific examples of the sulfur-containing compounds include, but are not limited to, dimethyl sulphoxide, sulfolane, and thiodiglycol.

Specific examples of the sugar groups include, but are not limited to, monosaccharides, disaccharides, oligosaccharides (including trisaccharides and tetrasaccharides), and polysaccharides. Specific examples thereof include, but are not limited to, glucose, mannose, fructose, ribose, xylose, arabinose, galactose, maltose, cellobiose, lactose, saccharose, trehalose, and maltotriose. Polysaccharides represent sugar in a broad sense and contain materials that are present widely in nature, for example, α-cyclodextrine and cellulose. In addition, specific examples of derivatives of these sugar groups include, but are not limited to, reducing sugars (for example, sugar alcohols (represented by $HOCH_2(CHOH)_nCH_2OH$, where n represents an integer of from 2 to 5) of the sugar groups specified above, oxidized sugars (e.g., aldonic acid and uronic acid), amino acid, and thio acid. Of these, sugar alcohols are preferable and specific examples thereof include, but are not limited to, maltitol and sorbit.

The contents of the water soluble organic solvent and the wetting agent have no particular limit and are preferably from 5% by weight to 80% by weight and more preferably from 10% by weight to 20% by weight in the entire of the processing fluid. When the content is not greater than 80% by weight, the drying property of a recording medium to which the processing fluid is attached does not deteriorate regardless of the kind of water soluble organic solvent and solid wetting agent or the agglomeration power of the processing fluid does not deteriorate significantly.

When the content is 5% by weight or greater, it can be prevented that the moisture contained in the processing fluid evaporates and the viscosity of the processing fluid increases, thereby causing trouble in the application process of the processing fluid.

Surfactant

Surfactants are added to improve the wettability of a processing fluid to a recording medium.

The content of the surfactant in the processing fluid is preferably from 0.001% by weight to 5% by weight and more preferably from 0.05% by weight to 2% by weight. When the content is 0.001% by weight or more, the addition of a surfactant has a good impact. However, the impact does not further increase over 5% by weight.

As the surfactants, for example, fluorine-containing surfactants, silicone-based surfactants, anionic surfactants, nonionic surfactants, and betaine-based surfactants can be suitably used. Of these, fluorine-containing surfactants are preferable. These surfactants can be used alone or in combination.

A fluorine-containing surfactant in which the number of carbon atoms replaced with fluorine atoms is from 2 to 16 is preferable and, 4 to 16, more preferable. When the number of carbon atoms is 2 or more, the impact of using a fluorine-containing surfactant is demonstrated, and no damage occurs to storage when the number of carbon atoms is 16 or less.

Specific examples of the fluorine-containing surfactants include, but are not limited to, perfluoroalkyl sulfonic acid compounds, perfluoroalkyl carboxylic acid compounds, perfluoroalkyl phosphoric acid ester compounds, adducts of perfluoroalkyl ethylene oxide, and polyoxyalkylene ether polymer compounds having a perfluoroalkyl ether group in its side chain. Of these, fluorine-containing surfactants having perfluoroalkyl groups are preferable.

Permeating Agent

Surfactants are added to improve the permeability of a processing fluid to a recording medium.

The content of the permeating agent is preferably from 0.1% by weight to 5.0% by weight. When the content is 0.1% by weight or more, the addition of a permeating agent has a good impact on permeation of the processing fluid.

In addition, when the content is 5.0% by weight or less, it can be prevented that the permeating agent is separated from the solvent, thereby saturating improvement of permeability.

The permeating agent is preferably non-wetting agent type polyol compounds or glycol ether compounds having 8 to 11 carbon atoms and preferably has a solubility of from 0.2% by weight of from 5.0% by weight in water at 25° C.

Of these, 2-ethyl-1,3-hexane diol (solubility: 4.2% at 25° C.) and 2,2,4-trimethyl-1,3-pentanediol (solubility: 2.0% at 25° C.) are particularly preferable.

Specific examples of the other non-wetting agent polyol compounds include, but are not limited to, aliphatic diols such as 2-ethyl-2-methyl-1,3-propanediol, 3,3-dimethyl-1,2-butanediol, 2,2-diethyl-1,3-propane diol, 2-methyl-2-propyl-1,3-propane diol, 2,4-dimethyl-2,4-pentanediol, 2,5-dimethyl-2,5-hexane diol, and 5-hexene-1,2-diol.

Other permeating agents that can be used in combination are any agent that can be adjusted to have desired characteristics when dissolved in a processing fluid. Specific examples thereof include, but are not limited to, alkyl and aryl ethers of polyols such as diethylene glycol monophenylether, ethylene glycol monophenyl ether, ethylene glycol monoallyl ether, diethylene glycol monophenyl ether, diethylene glycol monobutyl ether, propylene glycol monobutyl ether, and tetraethylene glycol chlorophenyl ether and lower alcohols such as ethanol.

Defoaming Agent

Defoaming agents are added to suppress foaming of a processing fluid. In general, a force to make the surface area as least as possible is applied to the liquid such as water having a high surface tension so that no or little foam is formed. A liquid having a small surface tension and a high viscosity tends to foam and foam formed is not easily defoamed. When the processing fluid of the present disclosure contains the water soluble cation polymer, the water soluble organic solvent, and the surfactant mentioned above, the surface tension of the processing fluid lowers and the viscosity thereof increases so that foams are easily formed. Therefore, it is preferable to add a defoaming agent.

The content of the defoaming agent in the processing fluid is preferably from 0.01% by weight to 10% by weight and more preferably from 0.02% by weight to 5% by weight. When the content is greater than 0.01% by weight, defoaming power is sufficient. In addition, when the content is 10% by weight or less, the defoaming agent is surely dissolved in a processing fluid.

pH Regulator

The pH regulator can be any agent capable of adjusting the pH of prescribed processing fluid to be from 6 to 10 and suitably selected to a particular application. When the pH is 10 or less, the agglomeration power does not significantly deteriorate. Moreover, when the pH is 6 or higher, transfer members such as transfer rollers that contact a processing fluid are not corroded, thereby having no problem to transfer features.

Preferred specific examples thereof include, but are not limited to, alcohol amines, hydroxides of alkali metal elements, ammonium hydroxides, phosphonium hydroxides, and alkali metal carbonates.

Specific examples of the alcohol amines include, but are not limited to, diethanol amine, triethanol amine, and 2-amino-2-ethyl-1,3-propane diol. Specific examples of the alkali metal hydroxides include, but are not limited to, lithium hydroxide, sodium hydroxide, and potassium hydroxide. Specific examples of the ammonium hydroxides include, but are not limited to, ammonium hydroxide and quaternary ammonium hydroxide. A specific example of the phosphonium hydroxides is quaternary phosphonium hydroxide. Specific examples of the alkali metal carbonates include, but are not limited to, lithium carbonate, sodium carbonate, and potassium carbonate.

Ink

The ink for use in the image forming method of the present disclosure has no particular selection limit and can be known ink containing a colorant, a water soluble organic solvent, a surfactant, a permeating agent, a water-dispersible resin, etc.

The viscosity of the ink is from 5 mPa·S to 20 mPa·S at 25° C. When the viscosity is 5 mPa·s, the density and the quality of an image to be recorded are improved. Moreover, when the viscosity is 20 mPa·s or less, good discharging property is obtained. Viscosity can be measured by, for example, a viscometer (RE-550L, manufactured by TOKI SANGYO CO., LTD.).

The surface tension of an ink is preferably from 20 mN/m to 35 mN/m and more preferably from 20 mN/m to 30 mN/m at 25° C. When the surface tension ranges from 20 mN/m to 35 mN/m, the permeability of the ink tends to be high. When recorded in plain paper, drying property is good, thereby suppressing color bleed. Moreover, the attached portion of a processing fluid of a recording medium tends to be wet and saturation of recorded matter becomes high, thereby suppressing white voids. When the surface tension is greater than 35 mN/m, the leveling of the ink on a recording medium tends to never or little occur, thereby prolonging the drying time.

Colorant

As the colorant, considering the weatherability, pigments are mainly used. Optionally, dyes can be added to adjust the color in an amount in which the weatherability is not degraded.

There is no specific limit to the selection of pigments. For example, inorganic pigments or organic pigments for black or color are suitably select to a particular application. These may be used alone or in combination of two or more thereof.

The content of the colorant in the ink is preferably from 2% by weight to 15% by weight and more preferably from 3% by weight to 12% by weight in solid. When the content ratio of the pigment is 2% by weight or more, the saturation or the density of recorded matter does not become low. When the content ratio of the pigment is 15% by weight or less, it is highly unlikely that viscosity increases, thereby degrading discharging stability.

The contents of the solid portions in an ink, can be measured by a known method, for example, a method of separating only a water dispersible colorant and a water soluble resin from the ink.

As the inorganic pigments, specific examples thereof include, but are not limited to, titanium oxide, iron oxide, calcium oxide, barium sulfate, aluminum hydroxide, barium yellow, cadmium red, and chrome yellow, carbon black manufactured by known methods such as contact methods, furnace methods, and thermal methods.

Specific examples of the organic pigments include, but are not limited to, azo pigments (azo lakes, insoluble azo pigments, condensed azo pigments, chelate azo pigments, etc.), polycyclic pigments (phthalocyanine pigments, perylene pigments, perinone pigments, anthraquinone pigments, quinacridone pigments, dioxazine pigments, indigo pigments, thioindigo pigments, isoindolinone pigments, and quinofuranone pigments, etc.), dye chelates (basic dye type chelates, acid dye type chelates), nitro pigments, nitroso pigments, and aniline black can be used. Of these, pigments having good affinity with water are preferable in particular.

Preferred specific examples of the pigments for black include, but are not limited to, carbon black (C.I. Pigment Black 7) such as furnace black, lamp black, acetylene black, and channel black, metals such as copper and iron (C.I. Pigment Black 11), metal oxides compounds such as titanium oxide, and organic pigments such as aniline black (C.I. Pigment Black 1).

Specific examples of the pigments for color include, but are not limited to, C.I. Pigment Yellow 1, 3, 12, 13, 14, 17, 24, 34, 35, 37, 42 (yellow iron oxide), 53, 55, 74, 81, 83, 95, 97, 98, 100, 101, 104, 408, 109, 110, 117, 120, 128, 138, 150, 151, 153, and 183; C.I. Pigment Orange 5, 13, 16, 17, 36, 43, and 51; C.I. Pigment Red 1, 2, 3, 5, 17, 22, 23, 31, 38, 48:2, 48:2 {Permanent Red 2B(Ca)}, 48:3, 48:4, 49:1, 52:2, 53:1, 57:1 (Brilliant Carmine 6B), 60:1, 63:1, 63:2, 64:1, 81, 83, 88, 101 (rouge), 104, 105, 106, 108 (Cadmium Red), 112, 114, 122 (Quinacridone Magenta), 123, 146, 149, 166, 168, 170, 172, 177, 178, 179, 185, 190, 193, 209, and 219; C.I. Pigment Violet 1 (Rhodamine Lake), 3, 5:1, 16, 19, 23, and 38; C.I. Pigment Blue 1, 2, 15, 15:1, 15:3 (Phthalocyanine Blue), 16, 17:1, 56, 60, and 63; C.I. Pigment Green 1, 4, 7, 8, 10, 17, 18, and 36.

Water Soluble Organic Solvent

Water soluble organic solvents for use in ink have no particular limit to its selection and preferably those specified for the processing fluid. The mass ratio of the water soluble colorant to the water soluble organic solvent in the ink has an impact on the discharging stability of the ink jetted from the recording head. If the amount of the water soluble organic solvent is small while the amount of the solid portion of the water soluble colorant is large, water around ink meniscus of nozzles tends to evaporate quickly, thereby causing poor discharging performance.

The content of the water soluble organic solvent in the ink is preferably from 20% by weight to 50% by weight and more preferably from 20% by weight to 45% by weight. When the content is 20% by weight or more, discharging stability does not deteriorate or waste ink does not easily fixate on the maintenance unit of a recording device. In addition, when the content is 50% by weight or less, the drying property on paper does not deteriorate or the quality of recorded matter does not deteriorate.

Surfactant

As the surfactant for use in the ink, the surfactant for use in the processing fluid specified above are preferable. Of these, it is preferable to select a surfactant that has a low surface tension, a high permeability, and an excellent leveling property without degrading dispersion stability irrespective of the kind of the water dispersible colorant and the combinational use with the water soluble organic solvent. Specifically, anionic surfactants, nonionic surfactants, silicone-containing surfactants, and fluorine-containing surfactants are preferable. Of these, silicone-containing surfactants and fluorine-containing surfactants are particularly preferable. These surfactants can be used alone or in combination.

The content of the surfactant in the ink is preferably from 0.01 percent by weight to 3.0 percent by weight and more preferably from 0.5 percent by weight to 2 percent by weight. When the content is 0.01% by weight or more, the addition of a surfactant has a good impact.

In addition, when the content is 3.0% by weight or less, permeability to a recording medium does not increase unnecessarily, thereby preventing decrease of the density of recorded images or occurrence of strike-through.

Permeating Agent

As the permeating agent for use in ink, the permeating agent for use in the processing fluid specified above are preferable.

The content of the permeating agent in ink is preferably from 0.1% by weight to 4.0% by weight. When the content is 0.1% by weight or more, drying property does not deteriorate, thereby preventing occurrence of image blur to recorded images. When the content is 4.0% by weight or less, the dispersion stability of a colorant deteriorates, nozzles does not clog, or permeation into a recording medium does not become excessively high, so Water Dispersible Resin Water dispersible resins are used to ameliorate water repellency, water resistance, or weatherability of recorded images and increase density and saturation by forming a film on the surface to which an ink is attached.

Specific examples of the water dispersible resins include, but are not limited to, condensation-based synthetic resins, addition-based synthetic resins, and natural polymers. These can be used alone or in combination.

Specific examples of the condensation-based synthesis resins include, but are not limited to, polyester resins, polyurethane resins, polyepoxy resins, polyamide resins, polyether resins, poly(meth)acrylic resins, acrylic-silicone resins, and fluorine-containing resins.

Specific examples of the addition-based synthetic resins include, but are not limited to, polyolefin resins, polystyrene resins, polyvinyl alcohol resins, polyvinyl ester resins, polyacrylic acid resins, and unsaturated carboxylic acid resins.

Specific examples of the natural resins include, but are not limited to, celluloses, rosins, and natural rubber. Of these, polyurethane resin particulates, acrylic-silicone resin particulates, and fluorine-containing resin particulates are preferable.

Moreover, the water dispersible resins can be homopolymers or copolymers and any of single phase structure type, core-shell type, and power feed type emulsions.

A water dispersible resin is used that has self-dispersiblity with its own hydrophilic group or no dispersibility while dispersibility is imparted by a surfactant or a resin having a hydrophilic group. Of these, emulsions of resin particles obtained by emulsification polymerization or suspension polymerization of ionomers or unsaturated monomers of a polyester resin or polyurethane resin are preferable.

Since dispersion destruction or breakage in molecule chains such as hydrolytic cleavage occurs to a water dispersible resin in a strong alkali or strong acid environment, pH is preferably from 4 to 12, more preferably from 6 to 11, and furthermore preferably from 7 to 9 in terms of miscibility with the water dispersible colorant in particular.

The average particle diameter (D50) of the water dispersible resin relates to the viscosity of the liquid dispersion. If the compositions and the concentration of the solid portion are the same, viscosity increases as the particle diameter decreases. Therefore, the average particle diameter (D50) of the water dispersible resin is preferably 50 nm or more in order to prevent viscosity from becoming excessively high when an ink is formed. In addition, particles having large particle diameters, for example, several tens μm, which is larger than the size of the nozzle of the head of a recording device. Particles having such large particle size present in an ink degrade discharging stability. To secure discharging stability of an ink, the average particle diameter ($D_{50}$) of the water dispersible resin in the ink is preferably 200 nm or less and more preferably 150 nm or less.

In addition, since the water dispersible resin fixes the water dispersible colorant onto paper, it is preferable to form a film at room temperature. Therefore, the minimum film-forming temperature (MFT) of the water dispersible resin is preferably 30° C. or lower. The glass transition temperature of the water dispersible resin is preferably from −40° C. or higher and more preferably from −30° C. or higher. When the glass transition temperature is −40° C. or higher, the viscidity of resin film does not become strong, so that tackiness (stickiness and viscosity) does not occur to recorded matter. The content of the water dispersible resin in an ink is preferably from 1 percent by weight to 15 percent by weight and more preferably from 2 percent % by weight to 7 percent by weight in a solid form.

Other Components

In addition to the components mentioned above, pH regulators, preservatives and fungicides, chelate reagents, corrosion inhibitors, anti-oxidants, ultraviolet absorbents, oxygen absorbents, light stabilizing agents, etc., can be added to the ink.

pH Regulator

The pH regulator can be any agent capable of adjusting the pH of an ink to be from 7 to 11 and suitably selected to a particular application. If the pH of an ink is within this range, the ink does not melt the head or an ink supply unit of a recording device, the ink is not altered or leaked, or problems such as bad discharging do not occur.

As the pH regulator, the same specified for the processing fluid can be used.

Preservatives and Fungicides

Specific examples of the preservatives and fungicides include, but are not limited, dehydrosodium acetate, sodium sorbinate, 2-pyridine thiol-1-oxide sodium, sodium benzoate, pentachlorophenol sodium, and 1,2-benzoisothiazoline-3-on sodium compounds.

Chelate Reagent

Specific examples of the chelate reagents include, but are not limited to, ethylene diamine sodium tetraacetate, nitrilo sodium triacetate, hydroxyethyl ethylene diamine sodium tri-acetate, diethylenetriamine sodium quinternary acetate, and uramil sodium diacetate.

Corrosion Inhibitor

Specific examples of the corrosion control (anti-corrosion) agents include, but are not limited to, acid sulfite, thiosodium sulfate, ammonium thiodiglycolate, diisopropyl ammonium nitride, pentaerythritol quaternary nitdride, dicyclohexyl ammonium nitride, and 1,2,3-benzotriazole.

Anti-Oxidant

Specific examples of the anti-oxidants include, but are not limited to, phenol-based anti-oxidants (including hindered phenol-based anti-oxidants), amino-based anti-oxidants, sulfur-based anti-oxidants, and phosphorous-based anti-oxidants.

Ultraviolet Absorber

Specific examples of the ultraviolet absorbers include, but are not limited to, benzophenone-based ultraviolet absorbents, benzotriazole-based ultraviolet absorbents, salicylate-based ultraviolet absorbents, cyanoacrylate-based ultraviolet absorbents, and nickel complex salt-based ultraviolet absorbents.

Recording Medium

The processing fluid of the present disclosure is particularly suitable to a recording medium (coated paper) having a coated layer. There is no specific limit to the selection of the coated paper, which can be selected to a particular application. The coated paper represents paper in which a coating material is applied to the surface of an original paper (substrate) to improve looking and smoothness. Such a coating material can be applied to one side or both sides of a substrate. In addition, the coating material is a mixture in which white pigments such as kaolin or calcium carbonate are mixed with a binder such as starch. Specific examples of such coated paper include, but are not limited to, art paper, coated paper, light-weight coated paper, cast paper, and micro-coated paper.

In general, coated paper has a transfer amount of pure water of from 1 mL/m$^2$ to 10 mL/m$^2$ in a contact time of 100 ms as measured by a dynamic scanning absorptometer. Dynamic scanning absorptometer (for example, K 350 series D type, manufactured by Kyowa Seiko Co., Ltd.) can precisely measure the absorption amount in an extremely short period of time, Image Forming Method The image forming method of the present disclosure includes a step of attaching a processing fluid to a recording medium and a step of discharging and attaching an ink by an inkjet method to the recording medium to form an image. In addition, it is suitable to provide a step of drying the processing fluid attached to the recording medium between the step of processing fluid attachment and the step of image forming.

Step of Attaching Processing Fluid

The step of attaching a processing fluid is executed by a method uniformly attaching the processing fluid to the surface of the recording medium. There is no specific limit to the selection of such methods. Specific examples of such methods include but are not limited, blade coating method, gravure coating method, gravure offset coating method, a bar coating method, roll coating method, knife coating method, air knife coating method, comma coating method, U comma coating method, AKKU coating method, smoothing coating method, microgravure coating method, reverse roll coating method, four or five roll coating method, dip coating method, curtain coating method, slide coating method, and die coating method.

The wet attached amount (the attached amount of the processing fluid prior to drying a recording medium) of the processing fluid to the recording medium preferably ranges from 0.1 g/m$^2$ to 10.0 g/m$^2$, and more preferably from 1.0 g/m$^2$ to 3.0 g/m$^2$. When the wet attached amount is 0.1 g/m$^2$ or more, the quality (density, saturation, color bleeding, feathering) of an image of recorded matter is improved. When the wet attached amount is 10.0 g/m$^2$ or less, the texture of the recorded matter is not damaged or the cost problem does not occur. Since the agglomeration power reaches the maximum at about 10.0 g/m$^2$, increasing the attachment amount more is meaningless.

Step of Drying Attached Processing Fluid

The step of drying the pre-processing fluid attached to a recording medium is executed by any method artificially drying the pre-processing fluid to a degree that no problem occurs to any transfer member that contacts the attached pre-processing fluid between the step of attaching the pre-processing fluid and image formation by jetting an ink after the attached pre-processing fluid is transferred to the recording medium or the image quality is not degraded by accumulation of contaminants. The drying temperature is preferably from 40° C. to 130° C. and more preferably from 80° C. to 100° C. When the drying temperature is 40° C. or higher, the processing fluid is dried smoothly. When the drying temperature is 130° C. or lower, no problems occur to a recording medium.

Examples of the drying methods are heat drum systems, oven systems, hot air spraying systems, and heated roller systems. In addition, these systems can be used in combination.

Incidentally, "drying" after applying the processing fluid to a recording medium does not mean that the recording medium looks dry as a result of the absorption of the processing fluid to the recording medium but the liquid such as water in the processing fluid evaporate to the degree that the processing fluid is solidified because it cannot keep the liquid state.

Step of Attaching Ink to Form Image

The process of forming an image by attaching an ink includes discharging the ink to attach it to a recording medium to which the processing fluid is attached or a recording medium after the step of drying the processing fluid.

It is preferable to use a method discharging ink by applying a stimulus (energy) thereto by a device to attach the ink. Various known inkjet recording methods can be employed. Such inkjet recording methods include a method recording images on continuous recording medium by single path system utilizing lined heads and a method employing a system of scanning heads.

There is no specific limit to the driving system of recording heads serving as a device to discharge an ink. This driving system includes a system using a piezoelectric element actuator utilizing lead zirconate titanate (PZT), a system utilizing thermal energy, a system using on-demand type heads utilizing an actuator utilizing electrostatic force, and a system recording by charge-control type heads of a continuous jetting type. In the system utilizing a thermal energy, arbitrarily controlling spraying (discharging) droplets is difficult so that image quality tends to vary depending on the kind of recording media. This issue can be solved by imparting a pre-processing fluid to the recording media, resulting in attainment of stable image quality irrespective of the kind of the recording media.

The image forming method of the present disclosure is particularly applicable to an inkjet recording device to conduct inkjet recording while conveying a recording medium at a high speed.

That is, if a recording medium is conveyed by transfer members at a high speed, for example, 10 m/minute to 200 m/minute, by a series of processes including applying and drying a particular processing fluid and applying an ink as in the present disclosure, the transfer members are free from trouble, degradation of the image quality due to accumulation of contaminants can be suppressed, and the image quality is maintained even the image is forcibly dried.

Inkjet Recording Device

The inkjet recording device of the present disclosure is described in detail with reference to FIG. 1.

An inkjet recording device 300 includes a recording medium transfer unit 301, a pre-processing unit 302 to apply a pre-processing fluid to a recording medium 203, an image forming processing unit 304, and a post-processing unit 305 to apply a post-processing fluid to the recording medium 203 after the image is formed thereon.

The recording medium transfer unit 301 has a sheet feeder 307, multiple transfer rollers, and a reeling unit 308. The recording medium 203 illustrated in FIG. 1 is continuous roll paper, reeled out from the sheet feeder 307 by the transfer rollers, transferred on a platen glass, and reeled up by the reeling unit 308.

Pre-Processing Unit

The recording medium 203 transferred from the recording medium transfer unit 301 is coated with the pre-processing fluid at the pre-processing unit 302. If an image is formed on a recording medium other than a special inkjet sheet, quality problems about feathering, density, coloring, strike-through, etc. and image robustness problems about water-proof, weatherability, etc. arise. To solve these problems, a pre-processing fluid having a power of agglomerating ink is applied to a recording medium before image forming to improve the image quality.

In the pre-processing process, a pre-processing fluid is evenly applied to the surface of a recording medium. There is no specific limit to the selection to a method applying the pre-processing fluid. Specific examples of the methods include, but are not limited to, blade coating method, gravure coating method, gravure offset coating method, bar code method, and roll coating method.

Figure 2:
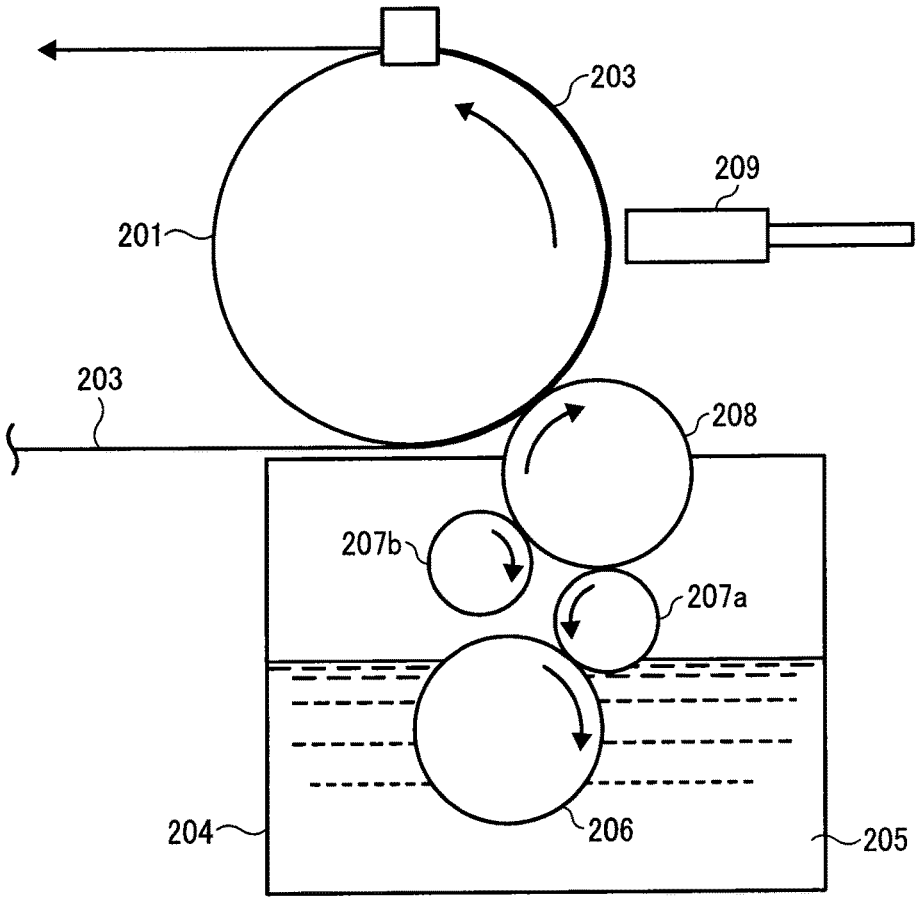
FIG. 2 is a schematic diagram illustrating an example of the configuration to apply a pre-processing fluid in a pre-processing unit.

FIG. 2 is a schematic diagram illustrating an example of the configuration to apply a pre-processing fluid in the pre-processing unit 302. The roll coating method is described here but the application method of pre-processing fluid is not limited thereto.

As illustrated in FIG. 2, the transfer rollers transfer the recording medium 203 into a pre-processing fluid application device 204. The pre-processing fluid application device 204 stores a pre-processing fluid 205 and the pre-processing fluid 205 is transferred to the roller surface of an application roller 208 in a thin film form by a stirring and supplying roller 206 and a transfer and thin-film forming rollers 207*a* and 207*b*. Thereafter, the application roller 208 rotates while being pressed against a rotatable counter roller 201 and the pre-processing fluid 205 is applied to the surface of the recording medium 203 while the recording medium 203 passes between the application roller 208 and the rotatable counter roller 201.

In addition, the counter roller 201 can adjust the nipping pressure by a pressure adjuster 209 when the pre-processing fluid is applied, so that the application amount of the pre-processing fluid 205 can be changed. In addition, the application amount can be adjusted by changing the rotation speed of the application roller 208. The application roller 208 and the platen roller 202 are driven by a power source such as drive motor. The rotation speed thereof can be changed by changing the energy of the power source to control the application amount.

As described above, the method applying the pre-processing fluid 205 to improve image quality to the recording area of the recording medium 203 by the application roller 208 can apply the pre-processing fluid 205 having a relatively high viscosity to form a thin film so that the feathering of images can be furthermore reduced in comparison with a method spraying a pre-processing fluid to a recording medium using a spraying head.

A post-pre-processing drying unit 303 can be provided to the pre-processing unit 302 after the application process as illustrated in FIG. 1.

The post-pre-processing drying unit 303 includes, for example, heat rollers 311 and 312 as illustrated in FIG. 1. This unit conveys the recording medium 203 to which the pre-processing fluid is applied to the heat rollers 311 and 312 by the transfer rollers. The heat rollers 311 and 312 are heated to high temperatures of 50° C. to 100° C. The moisture of the recording medium to which the pre-processing fluid 205 is applied evaporates by contact heat transfer from the heat rollers 311 and 312 so that the recording medium 203 becomes dry. The drying device is not limited to those. For examples, infra red drier, microwave drier, and a hot air device can be used. These can be used in combination, for example, a combination of a heat roller and hot air device. In addition, it is suitable to add a pre-heat step heating the recording medium 203 before the pre-processing fluid 205 is applied.

Image Forming Processing Unit

After the pre-processing process, images are formed on the recording medium 203 in the image forming processing unit 304 according to image data.

Figure 3:
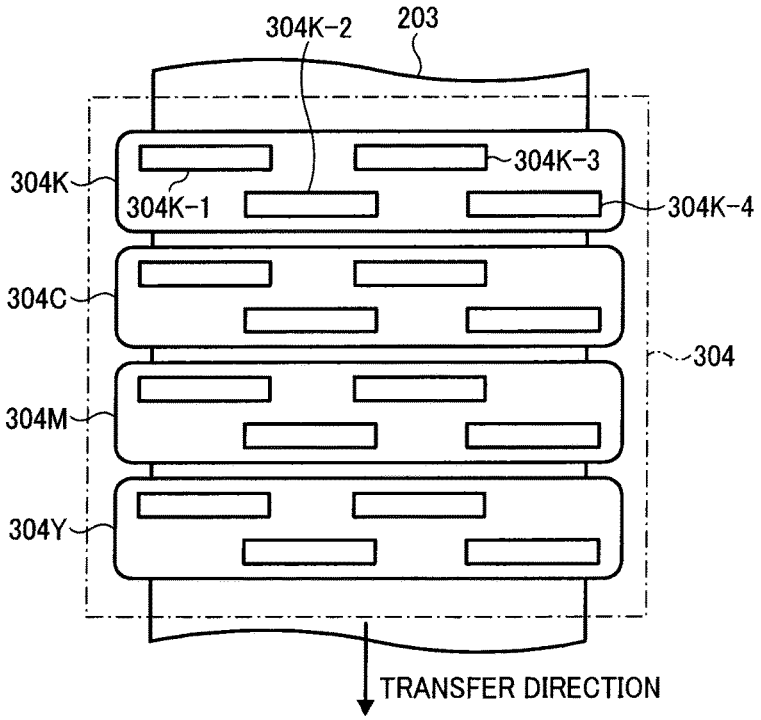
FIG. 3 is a diagram illustrating a state in which four short head units are arranged zig-zag along the vertical direction to the transfer direction to secure the print area width.
Figure 4:
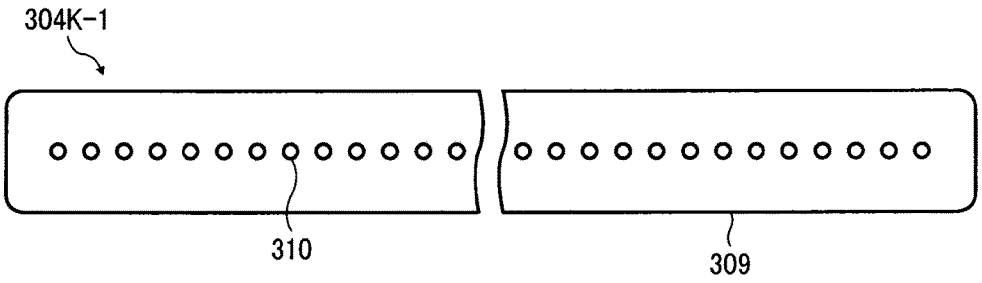
FIG. 4 is an enlarged view illustrating the head unit 304K-1.

The image forming processing unit 304 is a type of full-line type head including four recording heads 304K, 304C, 304M, and 304Y of black K, cyan C, magenta M, and yellow Y, respectively, arranged in this order from upstream of the transfer direction of the recording medium 203. For example, the recording head 304K has four short head units of 304K-1, 304K-2, 304K-3, and 304K-4 arranged zig-zag along the transfer direction of the recording medium 203 as illustrated in FIG. 3 to secure the print area width. FIG. 4 is an enlarged view illustrating the head unit 304K-1. As illustrated in FIG. 4, a nozzle surface 309 of the head unit 304K1 has multiple print nozzles 310 arranged along longitudinal direction of the head unit 304K-1 to form a nozzle array. In this embodiment, there is only one nozzle line but multiple nozzle lines can be arranged. The other heads 304C, 304M, and 304Y have the same configurations and the four recording heads 304K, 304C, 304M, and 304Y are arranged along the transfer direction spaced the same gap therebetween Therefore, an image can be formed in the entire printing area width by a single image forming operation.

Post-Processing Processing Unit

A post-processing fluid is optionally applied to the recording medium 203 by the post-processing unit 305 after image forming. The post-processing fluid contains a component to form a transparent protective layer on the recording medium 203.

In the post-processing process, the post-processing fluid is applied to the entire surface of the recording medium 203 or a particular part thereof. However, it is desirable to select the application amount and the application method according to the printing condition (for example, the kind of recording medium and the amount of ink discharged to recording medium).

Drying Process

After image forming or post-processing, a drying unit 306 is provided.

The drying unit 306 includes, for example, heat rollers 313 and 314 and a hot air spraying nozzle as illustrated in FIG. 1. This unit conveys the recording medium 203 to the heat rollers 313 and 314 by the transfer rollers after image forming or post-processing. The heat rollers 313 and 314 are heated to high temperatures. The moisture of the recording medium to which the post-processing fluid is applied evaporates by contact heat transfer from the heat rollers 313 and 314 so that the recording medium 203 becomes dry. Further downstream, a hot air device is provided as drying device. In addition, an infra-red drier, a microwave drying device can be used.

After drying, the recording medium 203 is reeled up by the reeling unit 308. If the pressure is strong during reeling, a phenomenon referred to as picking tends to occur in which the image on the recording medium 203 is transferred to the reverse side of the recording medium 203. However, if the drying efficiency is improved, such transfer can be suppressed even when images with a great amount of attached ink are printed at high speed. Moreover, it is possible to additionally provide a prior-to-reeling drier 315 as illustrated in FIG. 1.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Next, the present disclosure is described in detail with reference to Examples and Comparative Examples but not limited thereto. "%" in Examples and Comparative Examples represents "% by weight".

Preparation of Cation Polymer

A cation polymer was manufactured in the following manner and characteristics thereof were measured.

Measuring of Characteristics

Subsequent to three hour processing at 105° C. using an air circulating constant temperature tank (ETAC HIFLEX FX422P, manufactured by Kusumoto Chemicals, Ltd.), the solid portion was obtained by setting the loss on heating as evaporated component to obtain the solid portion concentration.

Measure the viscosity of the ink by a viscometer (RE-550L, manufactured by TOKI SANGYO CO., LTD.) at 25° C.

The weight average molecular weight was measured by gel permeation chromatography (GPC) (HLC-8320GPC EcoSEC, manufactured by TOSOH CORPORATION) using 0.1 mol/L of phosphoric acid buffer (pH2.1) as eluent with the column temperature of 40° C. and a flow speed of 1.0 mL/minute followed by molecule weight conversion using polyethylene glycol (PEG) as reference sample.

Manufacturing Example 1

200.0 g (2.218 mol) of 50% dimethyl amine and 291.0 g (1.477 mol) of 30% trimethyl amine were charged in a glass autoclave (1,000 mL) equipped with a stirrer, a thermometer, and a nitrogen introducing tube. Subsequent to nitrogen replacement, 274.0 g (2.961 mol) of epichlorohydrine was introduced thereto in two hours while being cooled down to 40° C. The resultant was caused to react for one hour at 40° C., thereafter heated to 80° C., and aged for three hours.

After cooling down, the pH was adjusted to 5.0 by 77.0 g of 35% hydrochloric acid and 0.82 g of 75% phosphoric acid (730 ppm for solid portion) to obtain a cation polymer having a solid portion concentration of 58%, a viscosity of 21 mPa·s, and weight average molecular weight of 3,000.

Manufacturing Example 2

In the same autoclave as in Manufacturing Example 1, 200.0 g (2.218 mol) of 50% dimethyl amine and 174.8 g (0.887 mol) of 30% trimethyl amine were charged. Subsequent to nitrogen replacement, 246.0 g (2.659 mol) of epichlorohydrine was introduced in two hours while being cooled down to 40° C. The resultant was caused to conduct reaction for one hour at 40° C., thereafter heated to 80° C., and aged for three hours.

After cooling down, the pH was adjusted to 5.0 by 46.2 g of 35% hydrochloric acid and 0.87 g of 75% phosphoric acid to obtain a cation polymer having a solid portion concentration of 60%, a viscosity of 40 mPa·s, and weight average molecular weight of 6,800.

Manufacturing Example 3

In the same autoclave as in Manufacturing Example 1, 200.0 g (2.218 mol) of 50% dimethyl amine and 218.5 g (1.109 mol) of 30% trimethyl amine were charged. Subsequent to nitrogen replacement, 257.0 g (2.777 mol) of epichlorohydrine was introduced in eight hours while being cooled down to 40° C. The resultant was caused to conduct reaction for four hours at 40° C., thereafter heated to 80° C., and aged for ten hours.

After cooling down, the pH was adjusted to 5.0 by 54.5 g of 35% hydrochloric acid and 0.92 g of 75% phosphoric acid to obtain a cation polymer having a solid portion concentration of 50%, a viscosity of 546 mPa·s, and weight average molecular weight of 13,000.

Examples 1 to 18 and 21 to 32 and Comparative Examples 1 to 6

Materials shown in each column of Examples and Comparative Examples in Tables 1 to 3 were used including the cation polymers manufactured in Manufacturing Examples 1 to 3. These materials were mixed and stirred in a beaker for 20 minutes using a stirring bar to prepare a processing fluid.

With regard to *1 in Tables, a suitable amount was added to adjust pH to be 7 to 9. With regard to *2 in Tables, concentrated before use until the effective component became 80%. With regard to *3 in Tables, concentrated before use until the effective component became 50%. The values in Tables are represented in % by weight.

TABLE 1

| | | | Examples | | | | | |
|---|---|---|---|---|---|---|---|---|
| | | | 1 | 2 | 3 | 4 | 5 | 6 |
| Flocculant | Cation polymer | Manufacturing Example 1 | 68.97 | 68.97 | 68.97 | 68.97 | 68.97 | 68.97 |
| | | Manufacturing Example 1 *2 | | | | | | |
| | | Manufacturing Example 2 | | | | | | |
| | | Manufacturing Example 3 | | | | | | |
| | | PE-10 | | | | | | |
| | | G5615 | | | | | | |
| | | PAS-A-1 *3 | | | | | | |
| | | PS-350 *3 | | | | | | |
| Corrosion inhibitor | Phosphoric acid-based inorganic salt | disodium monohydrogen phosphate | 0.50 | | | | | 0.50 |
| | | sodium dihydrogen phosphate | | 0.50 | | | | |
| | | sodium polyphosphate | | | 0.50 | | | |
| | | dipotassium monohydrogen phosphate | | | | 0.50 | | |
| | | potassium dihydrogen phosphate | | | | | 0.50 | |
| | Citrate | disodium citrate | | | | | | 0.50 |
| pH regulator | | 2-amino-2-ethyl-1,3-propane diol | Suitable amount *1 | Suitable amount *1 | Suitable amount *1 | Suitable amount *1 | Suitable amount *1 | Suitable amount *1 |
| Deionized water | | | Rest | Rest | Rest | Rest | Rest | Rest |
| Addition amount of cation polymer in processing fluid | | | 40 | 40 | 40 | 40 | 40 | 40 |

| | | | Examples | | | | | |
|---|---|---|---|---|---|---|---|---|
| | | | 7 | 8 | 9 | 10 | 11 | 12 |
| Flocculant | Cation polymer | Manufacturing Example 1 | 68.97 | 68.97 | 68.97 | 68.97 | 86.21 | |
| | | Manufacturing Example 1 *2 | | | | | | 75.00 |
| | | Manufacturing | | | | | | |

TABLE 1-continued

| | | | | | | | | |
|---|---|---|---|---|---|---|---|---|
| | | Example 2 | | | | | | |
| | | Manufacturing Example 3 | | | | | | |
| | | PE-10 | | | | | | |
| | | G5615 | | | | | | |
| | | PAS-A-1 *3 | | | | | | |
| | | PS-350 *3 | | | | | | |
| Corrosion inhibitor | Phosphoric acid-based inorganic salt | disodium monohydrogen phosphate | 2.50 | 2.00 | 0.20 | 2.00 | 0.50 | 0.50 |
| | | sodium dihydrogen phosphate | | | | | | |
| | | sodium polyphosphate | | | | | | |
| | | dipotassium monohydrogen phosphate | | | | | | |
| | | potassium dihydrogen phosphate | | | | | | |
| | Citrate | disodium citrate | | 0.50 | | | | |
| pH regulator | | 2-amino-2-ethyl-1,3-propane diol | Suitable amount *1 | Suitable amount *1 | Suitable amount *1 | Suitable amount *1 | Suitable amount *1 | Suitable amount *1 |
| Deionized water | | | Rest | Rest | Rest | Rest | Rest | Rest |
| Addition amount of cation polymer in processing fluid | | | 40 | 40 | 40 | 40 | 50 | 60 |

| | | | Examples | | | | | |
|---|---|---|---|---|---|---|---|---|
| | | | 13 | 14 | 15 | 16 | 17 | 18 |
| Flocculant | Cation polymer | Manufacturing Example 1 | | | | | | |
| | | Manufacturing Example 1 *2 | | | | | | |
| | | Manufacturing Example 2 | 66.87 | | | | | |
| | | Manufacturing Example 3 | | 80.00 | | | | |
| | | PE-10 | | | 78.44 | | | |
| | | G5615 | | | | 83.34 | | |
| | | PAS-A-1 *3 | | | | | 80.00 | |
| | | PS-350 *3 | | | | | | 80.00 |
| Corrosion inhibitor | Phosphoric acid-based inorganic salt | disodium monohydrogen phosphate | 0.50 | 0.50 | 0.50 | 0.50 | 0.50 | 0.50 |
| | | sodium dihydrogen phosphate | | | | | | |
| | | sodium polyphosphate | | | | | | |
| | | dipotassium monohydrogen phosphate | | | | | | |
| | | potassium dihydrogen phosphate | | | | | | |
| | Citrate | disodium citrate | | | | | | |
| pH regulator | | 2-amino-2-ethyl-1,3-propane diol | Suitable amount *1 | Suitable amount *1 | Suitable amount *1 | Suitable amount *1 | Suitable amount *1 | Suitable amount *1 |
| Deionized water | | | Rest | Rest | Rest | Rest | Rest | Rest |
| Addition amount of cation polymer in processing fluid | | | 40 | 40 | 40 | 40 | 50 | 60 |

TABLE 2

| | | | Comparative Examples | | | | | |
|---|---|---|---|---|---|---|---|---|
| | | | 1 | 2 | 3 | 4 | 5 | 6 |
| Flocculant | Cation polymer | Manufacturing Example 1 | 51.72 | 68.97 | 68.97 | | | |
| | | KPV100LU *3 | | | | 80.00 | | |

TABLE 2-continued

| | | | | | | | |
|---|---|---|---|---|---|---|---|
| | PAA-03 *3 | | | | | 80.00 | |
| Organic acid salt | Ammonium lactide | | | | | | 60.40 |
| Corrosion inhibitor | 1,2,3-benzotriazole | | | 2.00 | | | |
| | disodium monohydrogen phosphate | 0.20 | | | | | |
| pH regulator | 2-amino-2-ethyl-1,3-propane diol | Suitable amount *1 | Suitable amount *1 | Suitable amount *1 | Suitable amount *1 | Suitable amount *1 | Suitable amount *1 |
| Deionized water | | Rest | Rest | Rest | Rest | Rest | Rest |
| Addition amount of cation polymer in processing fluid | | 30 | 40 | 40 | 40 | 40 | 40 |

TABLE 3

| | | | Examples | | | | | |
|---|---|---|---|---|---|---|---|---|
| | | | 21 | 22 | 23 | 24 | 25 | 26 |
| Flocculant | Cation polymer | Manufacturing Example 1 | 68.97 | 68.97 | 68.97 | 68.97 | 68.97 | 68.97 |
| | | Manufacturing Example 2 | | | | | | |
| | | Manufacturing Example 3 | | | | | | |
| | | PE-10 | | | | | | |
| | | G5615 | | | | | | |
| | | PAS-A-1 *3 | | | | | | |
| | | PS-350 *3 | | | | | | |
| Corrosion inhibitor | p-tert-butyl benzoate | p-tert-butyl sodium benzoate | 0.20 | | 1.00 | 1.00 | 2.00 | 0.15 |
| | | LAMIPROOF A-1 (from DKS Co. Ltd.) | | 0.50 | | | | |
| | Citrate | disodium citrate | | | | 0.50 | | |
| pH regulator | | 2-amino-2-ethyl-1,3-propane diol | Suitable amount *1 | Suitable amount *1 | Suitable amount *1 | Suitable amount *1 | Suitable amount *1 | Suitable amount *1 |
| Deionized water | | | Rest | Rest | Rest | Rest | Rest | Rest |
| Addition amount of cation polymer in processing fluid | | | 40 | 40 | 40 | 40 | 40 | 40 |

| | | | Examples | | | | | |
|---|---|---|---|---|---|---|---|---|
| | | | 27 | 28 | 29 | 30 | 31 | 32 |
| Flocculant | Cation polymer | Manufacturing Example 1 | | | | | | |
| | | Manufacturing Example 2 | 66.67 | | | | | |
| | | Manufacturing Example 3 | | 80.00 | | | | |
| | | PE-10 | | | 78.44 | | | |
| | | G5615 | | | | 83.44 | | |
| | | PAS-A-1 *3 | | | | | 80.00 | |
| | | PS-350 *3 | | | | | | 80.00 |
| Corrosion inhibitor | p-tert-butyl benzoate | p-tert-butyl sodium benoate | 1.00 | 1.00 | 1.00 | 1.00 | 1.00 | 1.00 |
| | | LAMIPROOF A-1 (from DKS Co. Ltd.) | | | | | | |
| | Citrate | disodium citrate | | | | | | |
| pH regulator | | 2-amino-2-ethyl-1,3-propane diol | Suitable amount *1 | Suitable amount *1 | Suitable amount *1 | Suitable amount *1 | Suitable amount *1 | Suitable amount *1 |
| Deionized water | | | Rest | Rest | Rest | Rest | Rest | Rest |
| Addition amount of cation polymer in processing fluid | | | 40 | 40 | 40 | 40 | 40 | 40 |

Abbreviations shown in Tables represent as follows:

PE-10: dimethylamine*polyalkylene polyamine*epichlorohydrin (manufactured by Yokkaichi Chemical Co., Ltd., effective component: 51%)

G5615: Polydiallyl dimethyl ammonium chloride) (manufactured by DAI-ICHI KOGYO SEIYAKU CO., LTD., effective component: 48%)

PAS-A-1: Copolymers of diallyl dimethyl ammonium chloride*sulfur dioxide (manufactured by Nitto Boseki Co., Ltd., effective component: 40%)

PS-350: (acrylamide*[2-(acryloyloxy)ethyl]trimethyl ammonium chloride (manufactured by HYMO Co., Ltd.; effective component: 20%)

KPV100LU: polyacrylic acid estate (manufactured by SENKA corporation; effective component: 26%)

PAA-03: Polyallylamine (manufactured by Nitto Boseki Co., Ltd., effective component: 15%)

p-tert-butyl potassium benzoate (LAMIPROOF A-1, manufactured by DAI-ICHI KOGYO SEIYAKU CO., LTD. effective component: 40%)

The ink for use in image forming was prepared as follows:

Preparation Example 1

The following recipe was mixed and stirred to obtain an ink.

| | |
|---|---|
| Cyan dispersion element (PAC205, manufactured by Kao Corporation): | 20.0% |
| 1,3-butanediol: | 23.0% |
| Glycerin: | 8.0% |
| 2-ethyl-1,3-hexane diol: | 2.0% |
| Zonyl FS-300 (fluorine-containing surfactant manufactured by E. I. du Pont de Nemours and Company): | 1.0% |
| PROXEL LV (manufactured by AVECIA GROUP): | 0.2% |
| 2-amino-2-ethyl-1,3-propane diol: | 0.3% |
| Deionized water | 45.5% |

Preparation Example 2

The following recipe was mixed and stirred to obtain an ink.

| | |
|---|---|
| Yellow dispersion element (PAY204, manufactured by Kao Corporation): | 20.0% |
| 1,6-hexane diol: | 24.5% |
| Glycerin: | 8.0% |
| 2-ethyl-1,3-hexane diol: | 2.0% |
| Zonyl FS-300 (fluorine-containing surfactant manufactured by E. I. du Pont de Nemours and Company): | 0.5% |
| PROXEL LV (manufactured by AVECIA GROUP): | 0.2% |
| 2-amino-2-ethyl-1,3-propane diol | 0.3% |
| Deionized water | 44.5% |

Each processing fluid of Examples and Comparative Examples and the inks of Preparation Examples 1 and 2 were used to evaluate corrosion property and beading. The results are shown in Tables 4 to 6.

Corrosion Property 28.3 g of each processing fluid of Examples and Comparative Examples was weighed and charged in a glass bin and pellets (SUS304 of typical stainless steel material, Φ=12 mm, d=4 mm) were placed in the glass bin.

After being left at 50° C. for three weeks, SUS304 pellet was taken out and the processing fluid and corrosion of the surface of SUS304 pellet were visually observed followed by evaluation according to the following criteria.

The pellet was wiped with water, ethanol, and dry cloth to remove impurities of the surface of the pellet before placed in the processing fluid.

Evaluation Criteria

A: No corrosion at all

B: Slightly corroded without causing practical problem

C: Obviously corroded with practical problem

Beading

1. Each processing fluid of Examples and Comparative Examples was applied to the coated surface of a recording medium (LumiArt gloss paper, from Stora Enso, thickness: 90 g/m$^2$) in an amount of from 1.7 g/m$^2$ to 2.1 g/m$^2$ by a roller application method.

2. The recording medium to which the processing fluid was attached was placed in a constant temperature tank at 90° C. for 30 seconds to dry the processing fluid attached to the recording medium.

3. An ink in which negatively charged pigment particles were dispersed was spitted to the recording medium (not dried) of 1 described above and the recording medium (dried) of 2 described above by an aqueous inkjet recording method with a single path and 600 dpi (120 m/minute) to form images thereon. Thereafter, the degree of beading was visually checked and evaluated according to the following criteria.

The ink used was green ink made by the cyan ink of Preparation Example 1 and the yellow ink of Preparation Example 2 with a mass ratio of 1.15 to 1.00. The attached amount was $3.2\times10^{-8}$ g/cm$^2$.

Evaluation Criteria

A: No beading

B: Slight beading observed causing no practical problem

C: Beading confirmed causing problems with regard to image quality

D: Beading clearly observed

Corrosion (Polarization Curve)

Corrosion was evaluated under severe conditions with regard to Corrosion Property described above. Therefore, unless corrosion was visually observed, no practical problem would occur.

However, to check the level of corrosion property of a processing fluid, more detailed evaluation is suitable.

For this reason, the level of corrosion is determined by dissolved oxygen current density having a correlation with corrosion speed from a polarization curve obtained by electric chemical measuring method.

SI1280B (manufactured by Solartron) was used as the electric chemical measuring unit. The working electrode was fixed by an alligator clip in such a manner that 1.00 cm$^2$ of the plate of SUS304 was dipped in the processing fluid. Pt wire (Pt counter pole for VC-2, manufactured by BAS) was used as antipole and Ag/AgCl standard electrode (RE-1B, water-based reference electrode Ag/AgCl, manufactured by BAS) was used as reference electrode.

As the measuring condition, the voltage was changed from the initial value (natural voltage) to 1.5 V to measure an oxidized polarization curve. Thereafter, the sample of the working electrode and the processing fluid were replaced with fresh ones and the voltage was changed from the initial value (natural voltage) to −1.5 V to measure a reduced polarization curve.

The dissolved oxygen diffusion-limited current density I (A/cm$^2$) was evaluated according to the following evaluation criteria. A small value thereof means slow corrosion speed.

Evaluation Criteria

A: $I<3.00\times10^{-6}$

B: $3.00\times10^{-6}\leq I<5.00\times10^{-6}$

C: $5.00\times10^{-6}\leq I$

TABLE 4

| | Corrosion property | Image (beading) Not dried | Image (beading) Dried |
|---|---|---|---|
| Example 1 | A | A | A |
| Example 2 | A | A | A |
| Example 3 | B | A | A |
| Example 4 | A | A | A |
| Example 5 | A | A | A |
| Example 6 | A | A | A |
| Example 7 | A | A | A |
| Example 8 | A | A | A |
| Example 9 | B | A | A |
| Example 10 | A | A | A |
| Example 11 | B | A | A |
| Example 12 | B | A | A |
| Example 13 | A | A | A |
| Example 14 | A | A | A |
| Example 15 | A | A | A |
| Example 16 | A | B | B |
| Example 17 | A | B | B |
| Example 18 | A | B | B |
| Comparative Example 1 | A | C | C |
| Comparative Example 2 | D | A | A |
| Comparative Example 3 | D | A | A |
| Comparative Example 4 | A | D | D |
| Comparative Example 5 | A | D | D |
| Comparative Example 6 | A | A | D |

TABLE 5

| | Corrosion property | Image (beading) Not dried | Image (beading) Dried |
|---|---|---|---|
| Example 21 | B | A | A |
| Example 22 | B | A | A |
| Example 23 | A | A | A |
| Example 24 | A | A | A |
| Example 25 | A | A | A |
| Example 26 | B | A | A |
| Example 27 | A | A | A |
| Example 28 | A | A | A |
| Example 29 | A | A | A |
| Example 30 | A | B | B |
| Example 31 | A | B | B |
| Example 32 | A | B | B |

TABLE 6

| | Corrosion property (polarization curve) |
|---|---|
| Example 1 | C |
| Example 6 | B |
| Example 7 | B |
| Example 8 | A |
| Comparative Example 23 | C |
| Comparative Example 24 | B |

The following is found from the results shown in Tables 4 to 6.

The processing fluid of Examples has excellent corrosion property and produces excellent images in terms of beading.

The processing fluid of Examples to which a citrate is added has better corrosion resistance than the processing fluid free from the citrate.

Comparative Example 1, in which the addition amount of the cation polymer of the present disclosure is less than 40%, is inferior about beading.

Although Comparative Examples 2 and 3 contain suitable amounts of the cation polymers of the present disclosure, no phosphoric acid-based inorganic salt or p-tert-butyl benzoate is contained, thereby causing problems about corrosion property.

In Comparative Examples 4 and 5, other cation polymers are contained. No corrosion resistance problem occurs without containing a corrosion inhibitor but problems of beading arises.

In Comparative Example 6, a flocculant other than the cation polymer is used. It is free from problems about corrosion resistance and beading without drying. However, beading occurs when the recording medium is dried after the processing fluid is applied.

According to the present invention, a processing fluid is obtained which suppresses corrosion of members that contact the processing fluid while securing good image quality even when images are formed in high performance.

Having now fully described embodiments of the present invention, it will be apparent to one of ordinary skill in the art that many changes and modifications can be made thereto without departing from the spirit and scope of embodiments of the invention as set forth herein.

What is claimed is:

1. A processing fluid, comprising:

a water soluble cationic polymer having a quaternary ammonium cation in a main chain;

p-tert-butyl sodium benzoate or a p-tert-butyl potassium benzoate; and water, wherein the water soluble cationic polymer is included in an amount of from 40% by weight to 60% by weight, based on a total weight of the processing fluid.

2. The processing fluid according to claim 1, further comprising:

a citrate.

3. The processing fluid according to claim 1, wherein the processing fluid further comprises at least one phosphoric acid-based inorganic salt selected from the group consisting of disodium monohydrogen phosphate, sodium dihydrogen phosphate, sodium polyphosphate, dipotassium monohydrogen phosphate, and potassium dihydrogen phosphate.

4. The processing fluid according to claim 1, wherein the water soluble cationic polymer comprises a repeating unit represented by the formula:

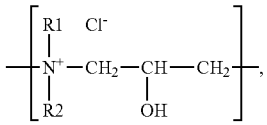

where R1 and R2 each independently represent an alkyl group, a hydroxyalkyl group, an alkenyl group, or a benzyl group, each having one to eight carbon atoms.

5. The processing fluid of claim 1, wherein the processing fluid has pH of 7 to 10.

6. The processing fluid of claim 1, wherein the water soluble cationic polymer comprises at least one selected from the group consisting of a copolymer of polyamine-epichlorohydrin, a copolymer of polyamide-epichlorohydrin, a polymer of dialkylallyl ammonium chloride, a polymer of dialkyl aminoethyl (meth)acrylate quaternary ammonium salt, a polymer of modified polyvinyl alcohol dialkyl ammonium salt, and a dialkylallyl ammonium salt.

7. The processing fluid of claim 3, wherein the processing fluid comprises 0.20% by weight to 2.00% by weight of the phosphoric acid-based inorganic salt, based on the total weight of the processing fluid.

8. The processing fluid of claim 1, wherein the processing fluid comprises 0.20% by weight to 2.00% by weight of the p-tert-butyl sodium benzoate or the p-tert-butyl potassium benzoate, based on the total weight of the processing fluid.

9. The processing fluid according to claim 3, wherein the at least one phosphoric acid-based inorganic salt comprises disodium monohydrogen phosphate.

10. The processing fluid according to claim 2, wherein the citrate is included in an amount of from 0.1% by weight to 2.00% by weight, based on the total weight of the processing fluid.

11. The processing fluid according to claim 2, wherein the citrate is at least one selected from the group consisting of sodium citrate, disodium citrate, tri sodium citrate, potassium citrate, ammonium citrate, calcium citrate, lithium citrate, and aluminum citrate.

12. The processing fluid according to claim 1, wherein the processing fluid comprises 0.50% by weight to 1.00% by weight of the p-tert-butyl sodium benzoate or the p-tert-butyl potassium benzoate, based on the total weight of the processing fluid.

13. The processing fluid according to claim 1, wherein the processing fluid comprises the p-tert-butyl sodium benzoate.

14. The processing fluid according to claim 1, wherein the processing fluid comprises the p-tert-butyl potassium benzoate.

15. An image forming method, comprising:

providing the processing fluid of claim 1 onto a recording medium; and discharging an aqueous ink onto the recording medium by an inkjet method to form an image on the recording medium.

16. The image forming method according to claim 15, wherein the processing fluid has pH of 7 to 10, and the aqueous ink has pH of 7 to 11.

17. The image forming method according to claim 15, wherein the recording medium has a substrate and a coated layer provided on at least one surface of the substrate.

18. Recorded matter, comprising:

a recording medium; and an image recorded on the recording medium by the image forming method of claim 15.

19. An inkjet recording device, comprising:

a processing fluid providing device to provide the processing fluid of claim 1 onto a recording medium; and an image forming device to discharge an aqueous ink onto the recording medium by an inkjet method such that an image is formed on the recording medium.

* * * * *